United States Patent [19]

Marshall et al.

[11] 4,073,173

[45] Feb. 14, 1978

[54] ROLLER GUIDES

[75] Inventors: Joseph W. Marshall, Sheffield; Keith C. Gibson, Kingston, both of England

[73] Assignee: British Steel Corporation, London, England

[21] Appl. No.: 733,310

[22] Filed: Oct. 18, 1976

[30] Foreign Application Priority Data

Oct. 17, 1975 United Kingdom ..... 42740/75

[51] Int. Cl.[2] ..... B21B 39/14

[52] U.S. Cl. ..... 72/250

[58] Field of Search ..... 72/251, 250, 227, 428, 72/246; 226/198, 199

[56] References Cited

U.S. PATENT DOCUMENTS

| | | | |
|---|---|---|---|
| 2,976,749 | 3/1961 | Albedyhl | 72/251 |
| 3,867,827 | 2/1975 | Backhaus et al. | 72/251 |

FOREIGN PATENT DOCUMENTS

| | | | |
|---|---|---|---|
| 14,069 | 8/1967 | Japan | 72/250 |
| 126,782 | 11/1949 | Sweden | 72/250 |
| 1,048,116 | 11/1966 | United Kingdom | 72/251 |

*Primary Examiner*—Milton S. Mehr
*Attorney, Agent, or Firm*—Bacon & Thomas

[57] ABSTRACT

A roller guide assembly for guiding a workpiece into the roll pass of a rolling mill has hydraulic or mechanical reaction means operable to apply a substantially constant load through the guide rollers to the workpiece irrespective of the lateral displacement of the rollers by the workpiece. The guide rollers are carried by pivotally mounted arms which extend lengthwise through the assembly housing and the reaction means bear against these arms.

11 Claims, 4 Drawing Figures

ROLLER GUIDES

This invention relates to roller guides which are used to guide a workpiece into the roll pass of a rolling mill.

Guides have been used for many years in conjunction with bar, rod and wire mills to steer the workpiece squarely into the roll groove of the rolling mill. The guides are mounted close to the rolls and in exact alignment with the groove. The modern form of guide usually incorporates rollers at the narrow exit end of a guiding funnel known as a slipper guide. The rollers are mounted for rotation each on a respective arm which is rigidly mounted to a guide housing, and the whole assembly is known as a roller guide.

When a workpiece enters the guide it is directed by the slipper guide into the gap between the two shaped rollers and thence into the roll groove. It is desirable for the shaped rollers to lightly grip the workpiece to ensure that it is properly located and in the case of a non-circular shaped workpiece eg. oval, to ensure that it is prevented from twisting as it is fed into the groove. For this reason, it is conventional for there to be one or two adjusting screws on each arm which are used to set the gap between the shaped rollers for a particular size of workpiece. The gap is usually set smaller than the expected entry width of the workpiece for that particular rolling mill stand. The construction of the guide assembly is such that each arm acts as a leaf spring pivoted about its rigid mounting on the housing, so that in use the rollers are resiliently biased towards the workpiece.

We have found that there are at least two disadvantages arising from this construction of roller guide. Firstly, if the workpiece is of larger width than that for which the rollers are set, the rollers are forced apart by the workpiece against the action of the leaf springs; the greater the deflection of the leaf spring, the greater the load on the roller and the workpiece. When a considerably over-size workpiece enters the rollers, the load can be such as to mechanically damage the rollers or their bearings, or the workpiece itself may be deformed by the rollers acting on it. With certain types of modern rolling mill using automatic height and width control systems one has to allow for relative large variations in inter-stand workpiece dimensions, so that the above-described problem is serious and requires frequent halts in rolling to replace or reset the roller guides.

One other problem arises when an undersize workpiece is fed through the guide. In this case the rollers may fail to hold the workpiece so that it twists in the guide and does not enter the roll groove squarely. In particular when rolling oval to round pass sequences, this can cause the workpiece to be rolled with a distorted cross-sectional shape. If the adjusting screws are reset so that the guide can hold an undersize workpiece, then any oversize material entering the rollers causes unsatisfactory stress on the rollers and their bearings because of the action of the leaf spring. In any case it may be very hazardous to the rolling mill operator to attempt to reset the adjusting screws whilst the mill is in use, so that rolling has to be halted whilst the screws are reset.

According to one aspect of the present invention, a roller guide assembly for guiding a workpiece into the roll pass of a rolling mill includes means associated with the assembly adapted to apply a substantially constant load through each exit guide roller of the assembly to the workpiece irrespective of the lateral displacement of the rollers by the workpiece.

The assembly may include means for adjusting the value of the constant load applied to the workpiece. The constant load may be applied by either hydraulic or mechanical means. The assembly may additionally include entry guide rollers for directing a workpiece into the pass of the exit guide rollers; furthermore, the assembly may include means adapted to apply a substantially constant load through each entry guide roller to the workpiece irrespective of the lateral displacement of the rollers by the workpiece.

According to the present invention in another aspect there is provided a roller guide assembly for guiding a workpiece into the roll pass of a rolling mill comprising a rigid housing, an exit guide roller mounted for rotation on each of a pair of arms which extend generally horizontally through the housing and which are secured to the housing through vertically spaced pivots, and reaction means operable to transmit a substantially constant load through each arm to the exit rollers and the workpiece irrespective of the lateral displacement of the rollers by the workpiece.

According to the present invention in a further aspect there is provided a roller guide assembly for guiding a workpiece into the roll pass of a rolling mill including means associated with the assembly adapted to apply a substantially equal load through each exit guide roller of the assembly to the workpiece irrespective of the lateral displacement of the rollers by the workpiece.

The invention will now be described by way of example only, with reference to the accompanying drawings, in which.

Figure 1:
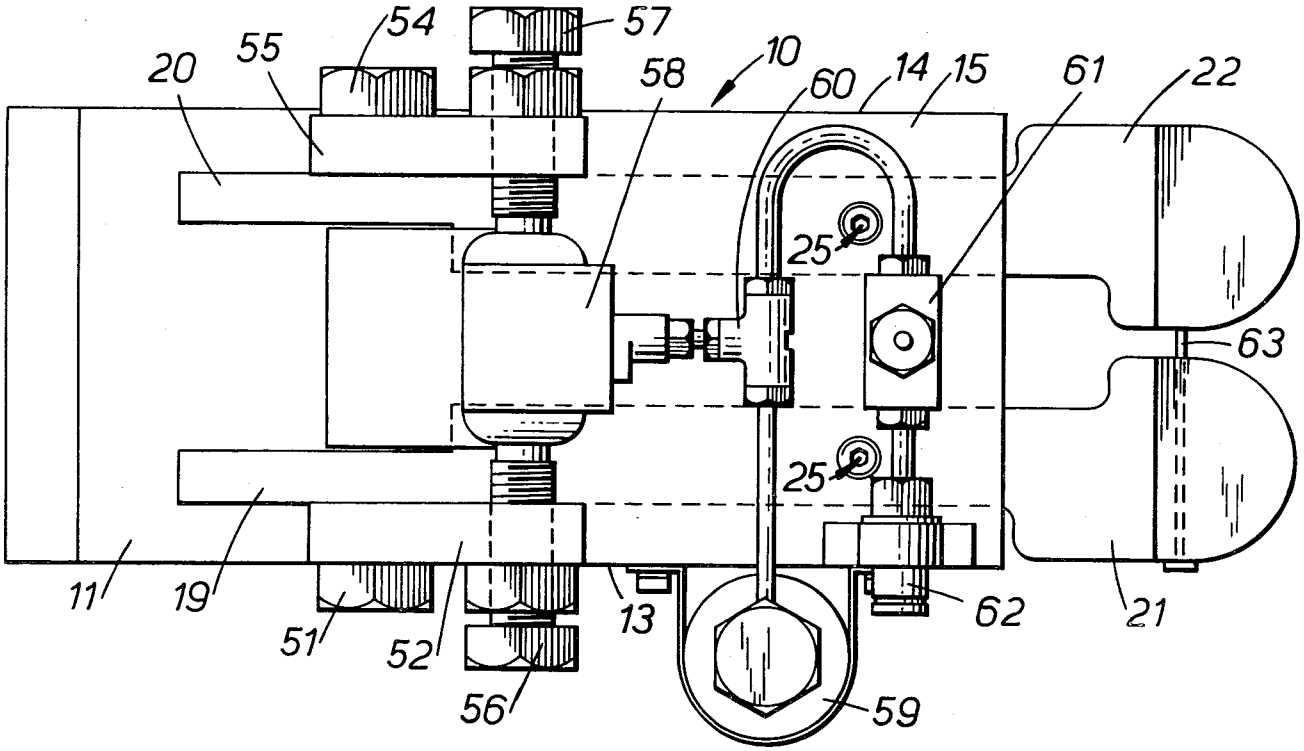
FIG. 1 is a plan view of a roller guide according to the invention.
Figure 2:
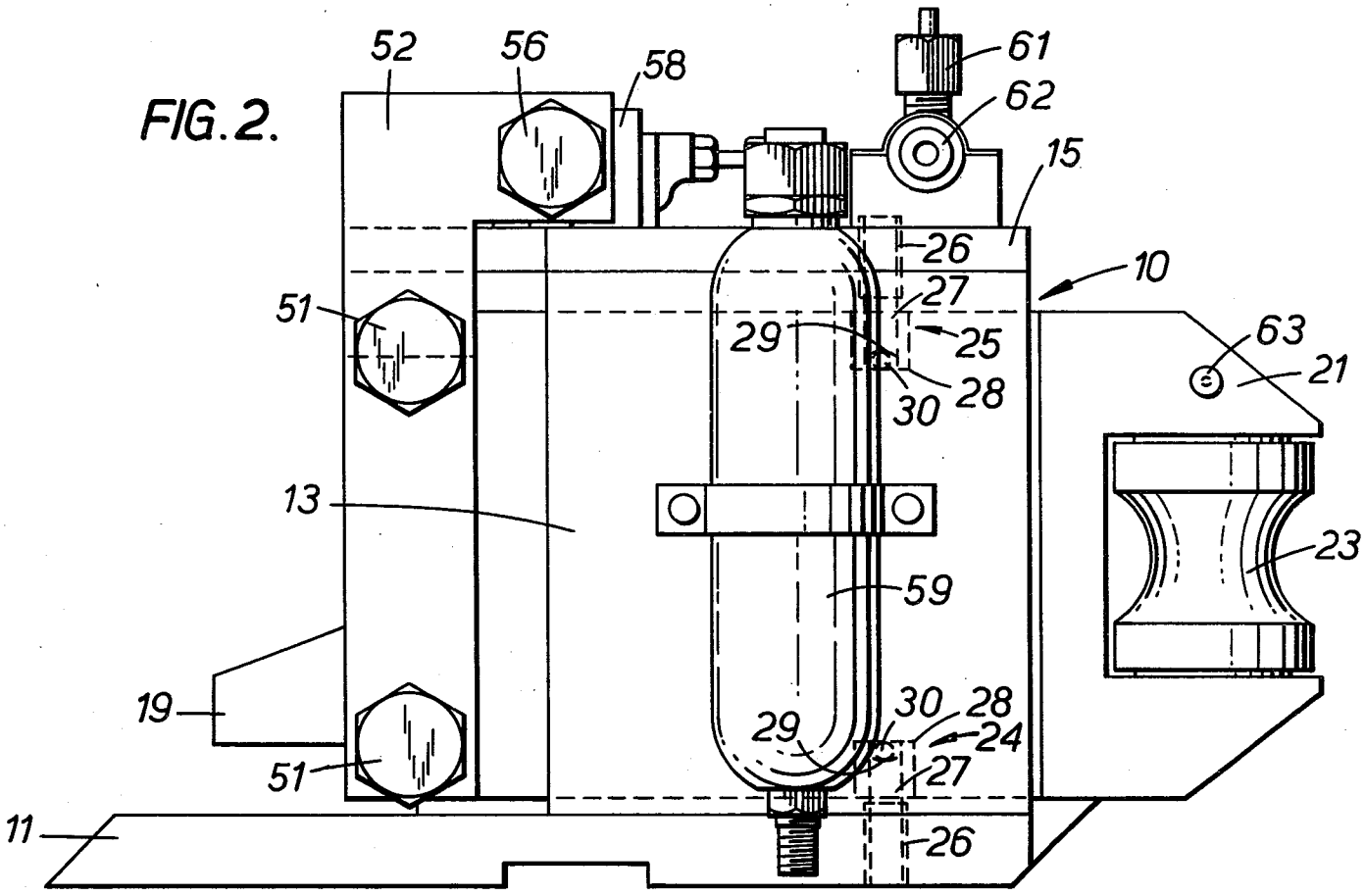
FIG. 2 is a side elevation of the roller guide of FIG. 1.

The roller guide illustrated in FIGS. 1 and 2 includes an upstanding housing 10 having a base 11 made in a single piece casting. A tail portion 11*a* of the base 11 extends from the lower part of housing 10.

The housing 10 has two parallel upstanding side walls 13 and 14 and a cover portion 15 supported by the two side walls 13, 14.

Two arms 19 and 20 are positioned within the housing 10 so that they extend roughly parallel through housing 10. Each arm 19 and 20 has an integral yoke 21 and 22 respectively, extending outside housing 10 at their ends distant from the tail portion 11. Identical exit guide rollers 23 are mounted respectively in yokes 21 and 22 through suitable bearings.

As illustrated, the rollers 23 have inwardly curved circumferential surfaces which are suitable for guiding the size and shape of workpiece to be rolled. Cooling water for the rollers 23 is supplied through internal channels (not shown) in the yokes 21 and 22 and is directed onto the rollers 23 through orifices (not shown) formed in the yokes. For different applications, rollers of different profile may be employed: for example, plane parallel-side rollers may be used to guide workpieces into the pass of grooveless work rolls.

A two-part slipper guide is retained within the arms 19 and 20 and serves to guide the workpiece through housing 10 to the rollers 23. The slipper guide may be replaced by or may include entry rollers of similar profile to rollers 23 for guiding the workpiece into the pass of the rollers 23.

The two arms 19 and 20 are located in their central regions with respect to the base 11 and cover 15 of housing 10 respectively by bottom and top pivots 24, 25 each comprising shanks having threaded ends 26 which screw into threads set in the base and cover of the housing and cylindrical end portions 27 of reduced diameter which extend into phosphorus-bronze bushes 28 set in the lower and upper faces of each arm 19, 20. The end faces 29 of the cylindrical end portion 27 are each machined with a concave seating into which protrude ball bearings 30 positioned within the bushes. The pivotal mountings are such that when the two rollers 23 are forced apart slightly, the arms 19 and 20 will pivot about vertical axes passing through the pivots 24, 25. The two arms 19 and 20 are held spaced from one another by a hydraulic device.

Arm 19 at its end distant from roller 23 is held rigidly by bolts 51 to the vertical portion of an inverted L-shaped member 52. Arm 20 is similarly held by bolts 54 to an identical L-shaped member 55. Both L-shaped members 52 and 55 are on the outside of the arms 19 and 20. The horizontal portions of L-shaped members 52 and 55 each have an adjusting screw, 56 and 57 respectively, extending through them and bearing on opposite ends of a double acting hydraulic actuator 58 situated on the top of housing 10. The dimensions and mountings of arms 19, 20, the L-shaped members 52, 55 and the actuator 58 are such that a one-to-one lever system exists between the load applied to rollers 23 and the load applied by actuator 58.

Associated with the hydraulic actuator 58 is a hydraulic circuit. An accumulator 59 is mounted on the side wall 13 of housing 10. At its upper end accumulator 59 is connectecd by hydraulic tubing to a T-piece 60. Of the two other arms of the T-piece one leads to the actuator 58 and the other is connected through a valve 61 to a quick release coupling 62.

A transducer may be located between the members 52, 55 to provide a measure of the spacing between the arms 19, 20 and, consequently, the dimensions of the workpiece passing between the rollers 23.

In use, the accumulator 59 is first charged with nitrogen to a predetermined pressure from a source of compressed nitrogen (not shown). The system is hydraulically pressurized using a hydraulic hand pump (not shown) connected to the quick release coupling 62 with the valve 61 open until a predetermined force is maintained by rollers 23, on a test bar placed between them. Valve 61 is then closed and the pump is disconnected from the coupling 62. The accumulator 59 will thereafter maintain the hydraulic pressure exerted actuator 58 approximately constant over the range of movement of rollers 23 which is expected in practice. The constant force or load is transmitted through the L-shaped members 52 and 55 to the respective arms 19, 20 and thence to the rollers 23. An adjustment stop 63 which extends through the yoke 21 and bears against the opposed surface of yoke 22 is provided to prevent rollers 23 coming too close together when no bar is present between them.

Since both sides of actuator 58 are subjected to the same pressure, the rollers 23 will always maintain the same load on either side of the bar or workpiece. If the guide rollers 23 for some reason are not accurately aligned with the groove of the work rolls there is an uneven force on the sides of the bar. The rollers 23 as a pair will move over until equilibrium is achieved which means that the bar accurately aligns with the groove or pass.

The arms 19, 20 can also be moved relative to one another in a vertical direction by suitable adjustment of the pivots 24, 25 so that rollers 23 can be aligned to each other vertically.

Figure 3:
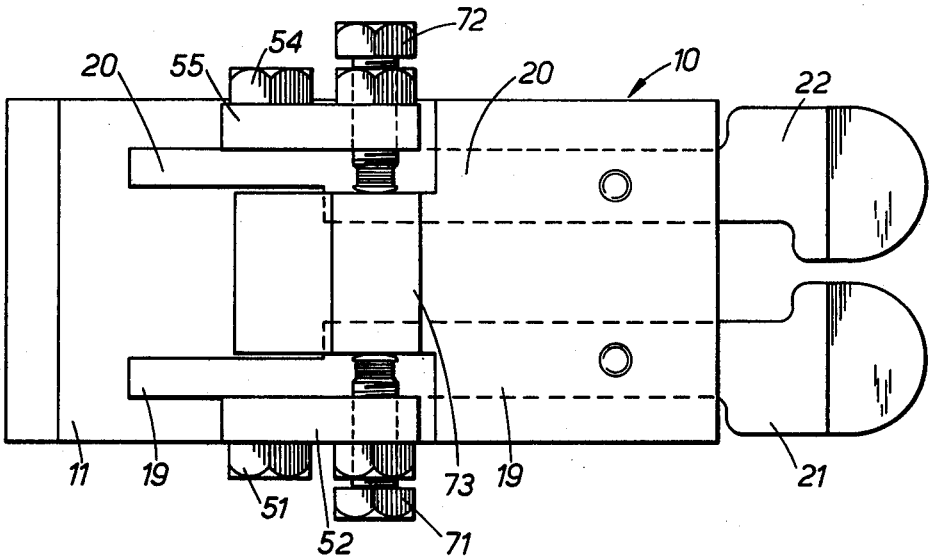
FIG. 3 is a plan view of a second roller guide according to the invention.

In the roller guide shown in plan in FIG. 3, the basic construction of the guide is very similar to that earlier described with reference to FIGS. 1 and 2. The hydraulic circuit is however no longer required and the adjusting screws 56 and 57 are replaced by reaction bolts 71 and 72 respectively.

Figure 4:
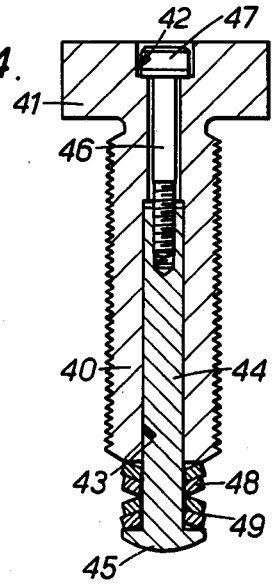
FIG. 4 shows an enlarged detail of FIG. 3.

The construction of each reaction bolt 71 and 72 is shown more clearly in FIG. 4. Each bolt 71 and 72 has a threaded shank 40 and a head 41. A cylindrical bore extends along the axis of the bolt, the bore having a first outwardly stepped portion 42 in the head 41 and a second outwardly stepped portion 43 opening onto the free end of shank 40. A cylindrical plunger 44 is received with a small clearance in the second stepped portion 43 and protrudes from the free end of shank 40 to terminate in a plunger head 45 which is of larger diameter than the remainder of the plunger 44. The plunger 44 is retained within the second stepped portion 43 of shank 40 by a retaining bolt 46 which passes through the head 41 and the bore of shank 40 to be threadedly received in the end of plunger 44. The retaining bolt 46 has a head 47 which is seated within the first stepped portion 42 of the bore through the reaction bolt 71, 72.

Two pairs of disc springs 48, 49 (which may be separated by a washer), surround the plunger 44 between the free end of shank 40 and the plunger head 45. As retaining bolt 46 is screwed into plunger 44, the disc springs 48, 49 gradually become flatter and exert a force tending to separate the plunger head 45 from the shank 40. Before the reaction bolts 71, 72 are screwed into their position in the roller guide, each retaining bolt 46 is adjusted so that the reaction bolt 71, 72 is preloaded to a predetermined value. This value will be the same for each of the reaction bolts 71, 72.

The reaction bolts 71, 72 bear on opposite sides of a rigid block 73 located centrally on top of the housing 10. The roller guide is set up for each particular cross-section of workpiece by adjusting the reaction bolts 71, 72 with respect to the arms 19, 20 so that if the workpiece is of normal cross-section, the rollers 23 are deflected slightly when the workpiece is fed between them. Each arm 19, 20 then pivots about a vertical line applying a load to the L-shaped members 52 and 55 to urge them together. The reaction bolts 71, 72 however will transit only a constant load along their axes because of the action of the disc springs 48, 49. Thus the workpiece is held with a constant load between the two rollers 23 even if the workpiece cross-section varies so that the rollers 23 are further separated or brought closer together.

In an unillustrated embodiment, the slipper guide of the guide assembly includes a pair of entry guide rollers for guiding a workpiece into the pass of the exit guide rollers; these entry guide rollers may be supported in a similar manner to the exit guide rollers 23 so that they apply a substantially constant load to a workpiece irrespective of their lateral spacing by the workpiece.

We claim:

1. A roller guide assembly for guiding a workpiece into a roll pass of a rolling mill which comprises a rigid housing, a pair of arms extending lengthwise of the housing generally in the intended direction of travel of a workpiece through the housing, guide rollers operable to engage the workpiece and to guide it into the roll pass of the mill, means for mounting for rotation one such guide roller on each said lengthwise extending arm at the exit end of the housing, a pair of pivots secured to the housing and extending generally parallel to the rotational axes of the guide rollers, means for pivotally mounting the arms one to each pivot and reaction means operable to transmit a substantially constant load to the workpiece through each guide roller of the assembly irrespective of any lateral displacement of the rollers by the workpiece.

2. An assembly as claimed in claim 1 further including means for adjusting the value of the constant load applied to the workpiece.

3. An assembly as claimed in claim 1 wherein the reaction means is positioned to bear against each arm at a location spaced from its pivotal mounting on the housing.

4. An assembly as claimed in claim 1 wherein each arm is formed with a rigid extension piece at its end remote from the guide rollers and wherein the reaction means is positioned to transmit the substantially constant load to the arms through the respective extension pieces.

5. An assembly as claimed in claim 1 wherein each arm bears against said reaction means, said reaction means comprising a hydraulically operated actuator, said actuator being connected through piping to an accumulator charged with fluid to a predetermined pressure.

6. An assembly as claimed in claim 5 wherein each arm is formed with a rigid extension piece which stands beyond the upper cover of the housing and wherein the hydraulically operated actuator is mounted on the housing cover and bears against opposed surfaces of the extension pieces to transmit the substantially constant load through the arms to the rollers and the workpiece.

7. An assembly as claimed in claim 6 wherein the accumulator is charged with nitrogen.

8. An assembly as claimed in claim 1 wherein the reaction means comprises a pair of preloaded reaction bolts.

9. An assembly as claimed in claim 8 wherein the reaction bolts are secured one to each of two rigid extensions formed one on the end of each arm remote from the guide rollers, each bolt bearing against a rigid block supported by the upper cover of the housing.

10. An assembly as claimed in claim 1 wherein the guide rollers are mounted for rotation within yokes intially spaced through an adjustable stop carried by one yoke.

11. A roller guide assembly for guiding a workpiece into a roll pass of a rolling mill which comprises a rigid housing, guide rollers operable to engage the workpiece and to guide it into the roll pass of the mill and comprising a pair of rotatable guide rollers mounted at the exit end of the housing and reaction means operable to transmit a substantially constant load to the workpiece through each guide roller of the assembly irrespective of any lateral displacement of the rollers by the workpiece.

* * * * *